US007890015B2

(12) United States Patent
Watanabe

(10) Patent No.: US 7,890,015 B2
(45) Date of Patent: Feb. 15, 2011

(54) COOLING MECHANISM OF FIXING DEVICE

(75) Inventor: Takaho Watanabe, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 413 days.

(21) Appl. No.: 12/044,089

(22) Filed: Mar. 7, 2008

(65) Prior Publication Data

US 2008/0304854 A1 Dec. 11, 2008

Related U.S. Application Data

(60) Provisional application No. 60/942,545, filed on Jun. 7, 2007.

(51) Int. Cl.
*G03G 15/20* (2006.01)
*G03G 21/00* (2006.01)

(52) U.S. Cl. ..... 399/92; 399/335; 399/336

(58) Field of Classification Search ..... 399/92, 399/93, 330, 335, 336; 219/619, 671, 672, 219/677

See application file for complete search history.

(56) References Cited

U.S. PATENT DOCUMENTS

| | | | | |
|---|---|---|---|---|
| 4,535,211 | A * | 8/1985 | Carter | 219/632 |
| 6,498,324 | B2 * | 12/2002 | Yamamoto et al. | 219/602 |
| 7,013,099 | B2 * | 3/2006 | Shirakata | 399/92 |
| 7,020,426 | B2 * | 3/2006 | Takagi et al. | 399/330 |
| 7,526,223 | B2 * | 4/2009 | Adachi et al. | 399/92 |
| 2008/0237223 | A1 * | 10/2008 | Kinouchi et al. | 219/619 |
| 2008/0267676 | A1 * | 10/2008 | Takai et al. | 399/335 |

FOREIGN PATENT DOCUMENTS

| | | | |
|---|---|---|---|
| JP | 2004-045717 | | 2/2004 |
| JP | 2006010932 | A * | 1/2006 |
| JP | 2006267426 | A * | 10/2006 |
| JP | 2006285126 | A * | 10/2006 |

* cited by examiner

*Primary Examiner*—David M Gray
*Assistant Examiner*—Fred Braun
(74) *Attorney, Agent, or Firm*—Turocy & Watson, LLP

(57) ABSTRACT

In a cooling mechanism for a fixing device according to an embodiment of the invention, a duct that flows outer air taken in by a fan is attached firmly to a slit formed between a bent coil part at an end part of a coil and a magnetic core in an induction heating device. The bent coil part is directly cooled without exerting influence of outer air on a heat roller, and temperature rise in the bent coil part is securely prevented.

13 Claims, 4 Drawing Sheets

COOLING MECHANISM OF FIXING DEVICE

CROSS REFERENCE TO RELATED APPLICATION

This invention is based upon and claims the benefit of priority from prior U.S. Patent Application 60/942,545 filed on Jun. 7, 2007, the entire contents of which are incorporated herein by reference.

BACKGROUND OF THE INVENTION

1. Field of the Invention

The present invention relates to a fixing device that is provided in an image forming apparatus such as a copy machine, printer or facsimile and fixes a toner image onto a sheet by using a heated member heated by induction heating of a coil, and particularly to a cooling mechanism of an image forming apparatus that prevents temperature rise of the coil.

2. Description of the Related Art

Recently, there has been an induction-heating fixing device used in an image forming apparatus such as an electrophotographic copy machine or printer. In this induction-heating fixing device, when the temperature of a coil in the induction heating device has risen and exceeded the Curie point, induction heating performance is lowered. When the temperature of the coil has exceeded the heat-resistance temperature of the insulating coating of a conductor wire, a safety problem occurs. Therefore, there has conventionally been a device to prevent temperature rise in the induction heating devise used in the fixing device. As such a fixing device, for example, JP-A-2004-45717 discloses a fixing device in which a radiation hole is formed in a housing of an induction heating unit, thus radiating heat that is emitted from a supporting frame, an induction heating device, a C-coil core and the like.

However, the conventional device is not suitable to cool a specific area in the induction heating device though it is possible to uniformly cool the entire area of the induction heating device. Meanwhile, there is an induction heating device in which the ends of a coil are substantially bent so as to compensate for the insufficient quantity of heat due to reduction of the magnetic field at the coil ends, or the insufficient quantity of heat due to reduction of the magnetic field in neighboring parts of a coil divided into plural parts. Thus, the length of the coil in the induction heating device is made as short as possible.

However, in the case where the ends are bent in this manner, temperature tends to rise more greatly and be higher at the bent parts of the coil than its other parts that are not bent. In the induction heating device using the coil with its ends bent in this manner, the bent parts cannot be efficiently cooled even when the entire device is cooled. As a result, reduction in induction heating performance or peeling of the coating of the conductor wire due to the temperature rise at the bent parts may occur.

Thus, in order to overcome the insufficient quantity of heat in the fixing device, even in the case where the coil ends in the induction heating device are bent, temperature at the bent parts of the coil is to be prevented from rising. It is desired that a cooling mechanism of a fixing device should be developed to realize a high-performance fixing device in which fixing failure due to the insufficient quantity of heat does not occur and in which temperature rise at the coil ends is prevented to achieve high induction heating performance and the coating of the conductor wire will not be peeled, thus maintaining safety.

SUMMARY OF THE INVENTION

According to an aspect of the invention, temperature rise in the coil of the induction heating device is prevented while the vicinity of the heated member of the fixing device is not deprived of heat. High induction heating performance of the induction heating device is maintained and safety of the conductor wire is maintained. As a result, there is provided a cooling mechanism of a fixing device that provides good fixation by uniformly heating the heated member over its total length in the longitudinal direction, using the induction heating device with high performance and high safety.

According to an embodiment of the invention, a cooling mechanism of a fixing device includes: a heated member which is endless and has a metal layer and, together with a counter-member, nips and carries a recording medium; a coil arranged on outer circumference of the heated member, having a flat part where a conductor wire is wound in a direction parallel to the metal layer and a bend part where the conductor wire is wound in a direction away from the metal layer and generating an induction current in the metal layer; and a cooling section in contact with the bent part.

DETAILED DESCRIPTION OF THE PREFERRED EMBODIMENT

Figure 1:
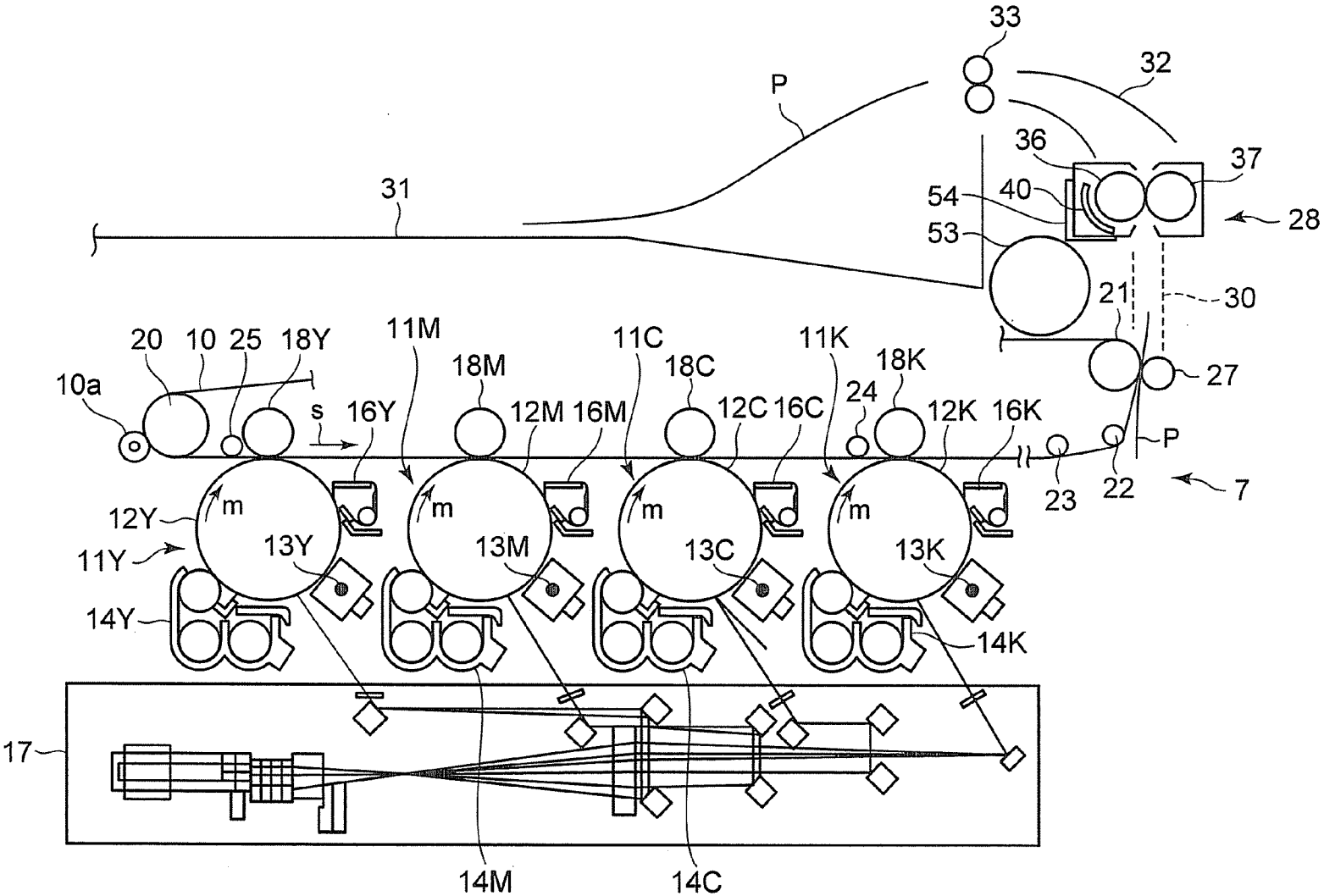
FIG. 1 is a schematic configuration view showing an essential part of a printer equipped with a fixing device according to an embodiment of the invention.

Hereinafter, an embodiment of the invention will be described in detail with reference to the attached drawings. FIG. 1 is a schematic configuration view showing an essential part of a printer unit 7 of a four-drum tandem color copy machine equipped with a fixing device 28 according to the embodiment of the invention. In the printer unit 7, image forming stations 11Y, 11M, 11C and 11K for the colors of yellow (Y), magenta (M), cyan (C) and black (K) are arrayed in tandem along the bottom side of a transfer belt 10 turned in the direction of an arrow S. The printer unit 7 further includes a laser exposure device 17 that irradiates a laser beam corresponding to image information onto photoconductive drums 12Y, 12M, 12C and 12K of the image forming stations 11Y, 11M, 11C and 11K for each color.

In the yellow (Y) image forming station 11Y of the printer unit 7, a charger 13Y, a developing device 14Y, a transfer roller 18Y and a cleaner 16Y are arranged around the photoconductive drum 12Y, which rotates in the direction of an arrow m. The magenta (M), cyan (C) and black (K) image forming stations 11M, 11C and 11K have the similar configuration to the yellow (Y) image forming station 11Y.

The transfer belt 10 is tensioned by a driving roller 21, a driven roller 20 and first to fourth tension rollers 22 to 25. At a secondary transfer position where the transfer belt 10 is supported by the driving roller 21, a secondary transfer roller 27 is arranged to face the transfer belt 10. At the secondary transfer position, a toner image on the transfer belt 10 is secondary-transferred to a sheet paper P as a recording medium by a transfer bias supplied from the secondary transfer roller 27. Downstream of the secondary transfer roller 27 in the periphery of the transfer belt 10, a belt cleaner 10*a* is arranged to face the transfer belt 10. The belt cleaner 10*a* collects the residual toner on the transfer belt 10 after the end of the secondary transfer, as waste toner.

The fixing device 28 is provided along a longitudinal path 30, downstream of the secondary transfer position. Further downstream of the fixing device 28, a paper discharge carrying path 32 and paper discharge rollers 33 to carry the sheet paper P after fixation to a paper discharge unit 31 are provided.

In the printer unit 7, as print operation is started, the photoconductive drum 12Y in the yellow (Y) image forming station 11Y is rotated in the direction of the arrow m and uniformly charged by the charger 13Y. Then, the photoconductive drum 12Y is irradiated with exposure light corresponding to image information by the laser exposure device 17 and thus has an electrostatic latent image formed thereon. After that, a toner image is formed on the photoconductive drum 12Y by the developing device 14Y. The toner image on the photoconductive drum 12Y is primary-transferred onto the transfer belt 10 turned in the direction of the arrow s, at the position of the transfer roller 18Y. After the end of primary transfer, the photoconductive drum 12Y has the residual toner removed by the cleaner 16Y and is made available for the next print.

The magenta (M), cyan (C) and black (K) image forming stations 11M, 11C and 11K carry out image forming operation similarly to the yellow (Y) image forming station 11Y. The toner images of magenta (M), cyan (C) and black (K) formed by the magenta (M), cyan (C) and black (K) image forming stations 11M, 11C and 11K respectively are sequentially primary-transferred to the transfer belt 10. Thus, a full-color toner image as a result of multiple transfer of the toner images of yellow (Y), magenta (M), cyan (C) and black (K) is formed on the transfer belt 10.

The full-color toner image, formed by superimposing the toner images on the transfer belt 10, then reaches the secondary transfer position and is secondary-transferred onto the sheet paper P at a time by a transfer bias from the secondary transfer roller 27. The sheet paper P is supplied to the secondary transfer position synchronously with the timing when the full-color toner image on the transfer belt 10 reaches the secondary transfer position. After that, on the sheet paper P with the full-color toner image transferred thereto, the full-color toner image is fixed by being heated and pressurized by the fixing device 28. The printer image is thus completed and the sheet paper P is discharged to the paper discharge unit 31.

Figure 2:
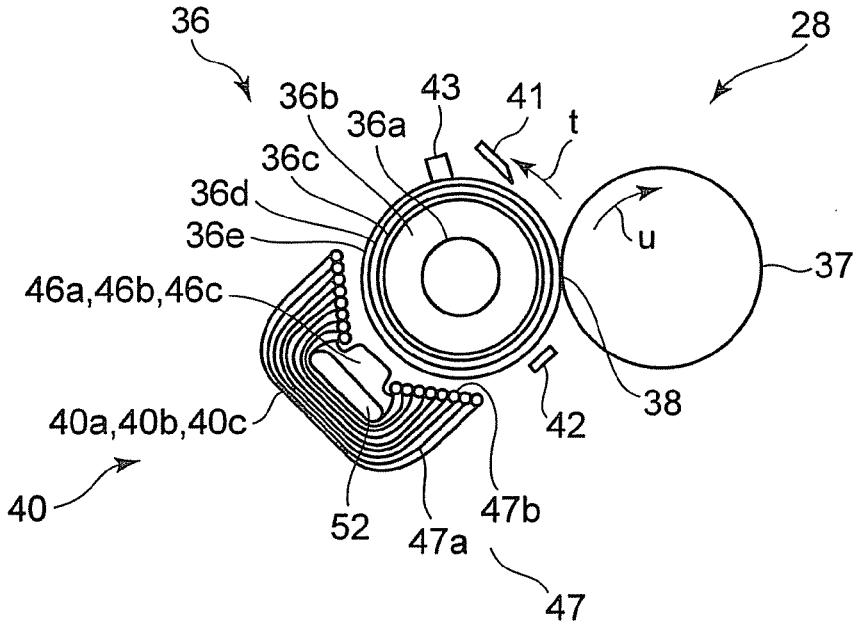
FIG. 2 is a schematic configuration view showing the fixing device according to the embodiment of the invention.

The fixing device 28 will now be described. FIG. 2 is a schematic configuration view showing the fixing device 28. The fixing device 28 has a heat roller 36, which is an endless heated member, and a press roller 37 as a counter-member. The heat roller 36 includes a core metal 36*a* covered with sponge rubber layer 36*b*, and a metal layer 36*c* made of, for example, nickel (Ni), provided on the sponge rubber layer 36*b*. The heat roller 36 also has a solid rubber layer 36*d* on the surface of the metal layer 36*c*, and a separation layer 36*e* thereon. The metal layer 36*c*, the solid rubber layer 36*d* and the separation layer 36*e* may be integrally formed and configured to be slidable on the sponge rubber layer 36*b* instead of being adhered to the sponge rubber layer 36*b*. At the time of fixing, the heat roller 36 is driven in the direction of an arrow t, and the press roller 37 is pressurized in contact with the heat roller 36. This forms a nipping part 38 with a predetermined width between the heat roller 36 and the press roller 37. The press roller 37 follows the heat roller 36 and rotates in the direction of an arrow u. As the sheet paper P passes through the nipping part 38 between the heat roller 36 and the press roller 37, the toner image on the sheet paper P is fixed by being heated and pressurized.

In the outer peripheral area of the heat roller 36, an induction heating device 40 to heat the metal layer 36*c* of the heat roller 36 is arranged to face the heat roller 36 via a gap. Moreover, a separation pawl 41 that prevents the sheet paper P from being wound after fixation, a thermistor 42 that detects the surface temperature of the heat roller 36, and a thermostat 43 that detects anomaly in the surface temperature of the heat roller 36 and interrupts heating, are provided in the outer peripheral area of the heat roller 36. Meanwhile, the press roller 37 may have a metal layer that is heated by the induction heating device 40, or may have a heating mechanism such as a built-in halogen lamp heater, when necessary.

Figure 3:
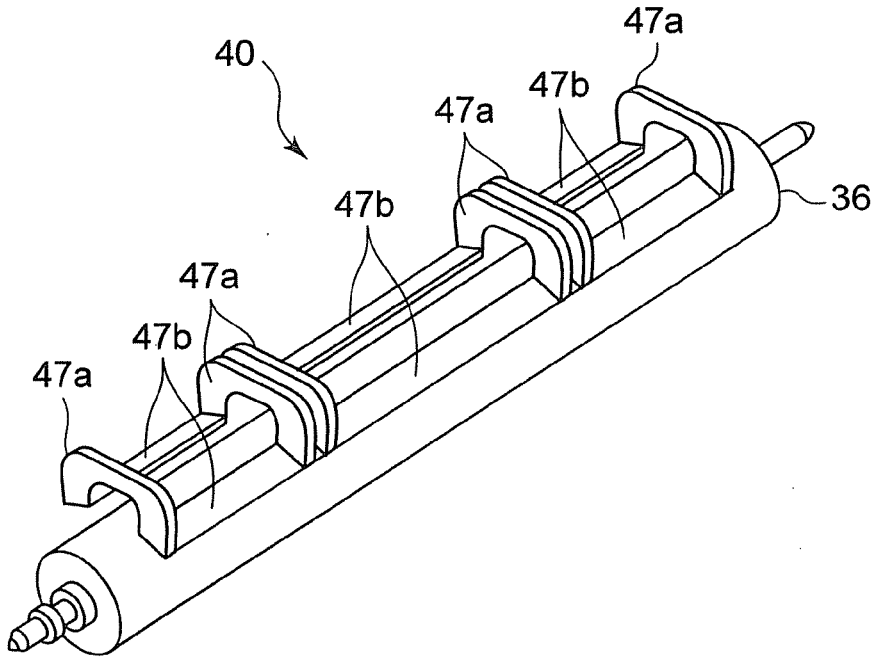
FIG. 3 is a schematic perspective view showing coils of an induction heating device according to the embodiment of the invention.
Figure 4:
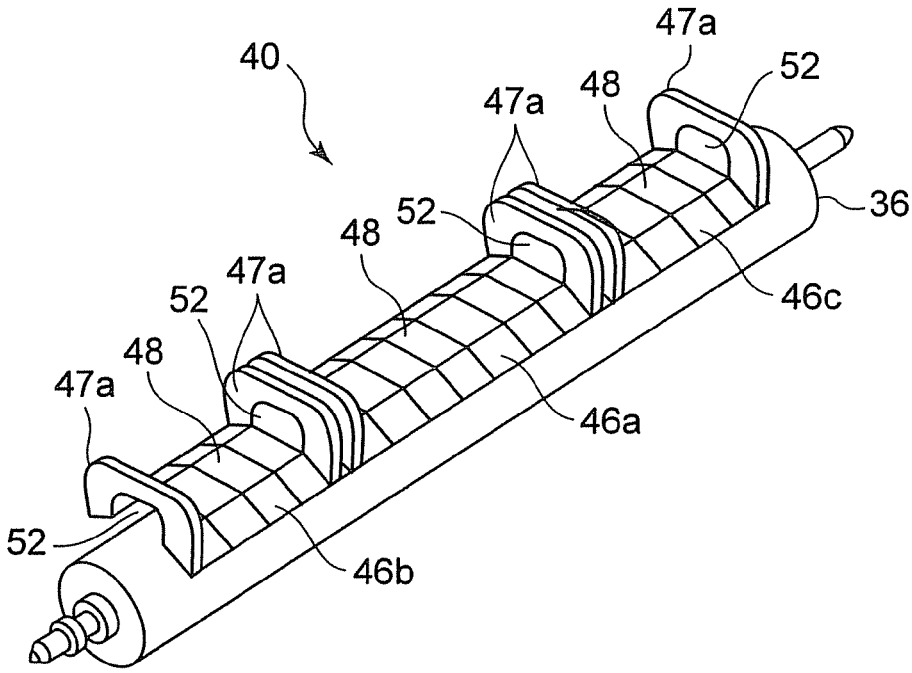
FIG. 4 is a schematic perspective view showing a magnetic core according to the embodiment of the invention.

The induction heating device 40 will now be described. As shown in FIG. 3, the induction heating device 40 has three coils, namely, a center coil 40*a*, a front-side coil 40*b*, and a rear-side coil 40*c*. The front-side coil 40*b* and the rear-side coil 40*c* are connected in series and driven under the same control. As shown in FIG. 4, the center coil 40*a* and the front- and rear-side coils 40*b* and 40*c* are formed by having a conductor wire 47 wound a predetermined number of times around magnetic cores 46*a*, 46*b* and 46*c* respectively for concentrating magnetic fluxes on the heat roller 36. The number of turns the conductor wire 47 is wound around the magnetic cores 46*a*, 46*b* and 46*c* is not particularly limited.

As the conductor wire 47, a Litz wire is used which is formed as a bundle of plural copper wires coated with an insulating film made of, for example, polyamide-imide, which is an insulting material and has heat resistance. The magnetic cores 46*a*, 46*b* and 46*c* have a substantially roof-shaped cross section with both lateral sides thereof bent slanted. However, the shape of the magnetic cores is not limited to this. For example, they may be formed in an arc shape parallel to the surface of the heat roller 36.

When a predetermined high-frequency current is supplied to the conductor wire 47 in the induction heating device 40, the center coil 40*a* and the front and rear-side coils 40*b* and 40*c* generate magnetic fluxes. These magnetic fluxes generate an eddy-current to prevent change in the magnetic field in the metal layer 36*c* of the heat roller 36. This eddy-current and the resistance value of the metal layer 36*c* generate Joule heat in the metal layer 36*c*, and the heat roller 36 is instantaneously heated.

The center coil 40*a* of the induction heating device 40 heats the central area of the heat roller 36. The front- and rear-side coils 40*b* and 40*c* arranged on both side of the center coil 40*a* heat both sides of the heat roller 36. The heat roller 36 is heated across its total length by the center coil 40*a* and the front- and rear-side coils 40*b* and 40*c*. The center coil 40*a* and the front- and rear-side coils 40*b* and 40*c* may be switched alternately to make output, or may be caused to make output simultaneously.

Next, the way of winding the conductor wire 47 of the center coil 40*a* and the front- and rear-side coils 40*b* and 40*c* will be described. The conductor wire 47 wound around the magnetic cores 46*a*, 46*b* and 46*c* is wound in a manner of being stacked in a direction away from the heat roller 36, at a front end part of the front-side coil 40*b*, a rear end part of the rear-side coil 40*c*, and neighboring end parts of the center coil

40*a* and the front- and rear-side coils 40*b* and 40*c*. Thus, bent coil parts 47*a* as bent parts are formed at the front end part of the front-side coil 40*b*, the rear end part of the rear-side coil 40*c*, and the neighboring end parts of the center coil 40*a* and the front- and rear-side coils 40*b* and 40*c*. To form the bent coil part of each coil, the end part can be bent after the conductor wire is wound around the magnetic core a predetermined of times.

Meanwhile, in a direction parallel to the direction of the rotation axis of the heat roller 36 in the center coil 40*a* and the front- and rear-side coils 40*b* and 40*c*, the conductor wire 47 is simply wound along the slant of the magnetic cores 46*a*, 46*b* and 46*c*, instead of being stacked. Thus, parallel coil parts 47*b* as flat parts are formed on the center coil 40*a* and the front- and rear-side coils 40*b* and 40*c*.

As the conductor wire 47 is sequentially stacked in this manner at each end part of the center coil 40*a* and the front- and rear-side coils 40*b* and 40*c* and thus forms the bent coil parts 47*a*, the width of the neighboring parts between the center coil 40*a* and the front- and rear-side coils 40*b* and 40*c* can be made narrow, and the center coil 40*a* and the front- and rear-side coils 40*b* and 40*c* can be made closer to each other. Moreover, at the front end part of the front-side coil 40*b* and the rear end part of the rear-side coil 40*c*, the area where the metal layer 36*c* is substantially heated by induction heating can be expanded. This enables realization of uniform surface temperature of the heat roller 36 in a broader area.

However, in the bent coil part 47*a* of the conductor wire 47, heat by self-heating of the conductor wire 47 is accumulated because of its structure, and temperature rises there, compared to the parallel coil part 47*b*. If the temperature of the conductor wire 47 has exceeded a temperature standard included in safety standards because of the temperature rise, there is a risk that the insulating film on the conductor wire 47 may be stripped. To deal with this, heat resistance capability of the film must be improved and this may lead to increase in the cost of the conductor wire 47. Moreover, if the temperature of the conductor wire 47 has exceeded the Curie point because of the temperature rise, the magnetic permeability of the magnetic cores 46*a*, 46*b* and 46*c* sharply declines. The heating performance of the induction heating device 40 for the heat roller 36 may be significantly lowered and the fixing device 28 may become incapable of fixing.

Figure 5:
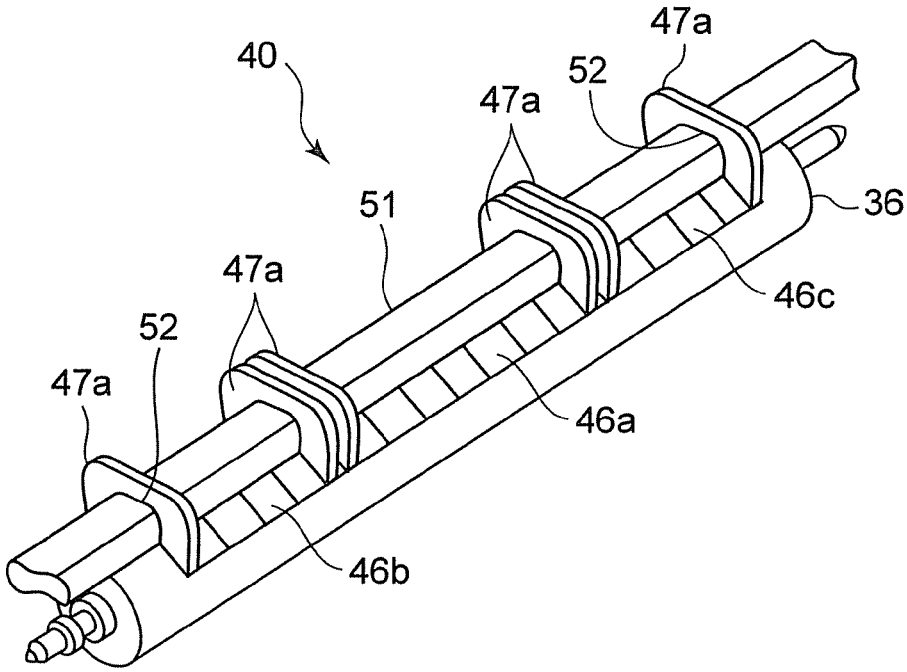
FIG. 5 is a schematic perspective view showing a duct on the magnetic core according to the embodiment of the invention.
Figure 6:
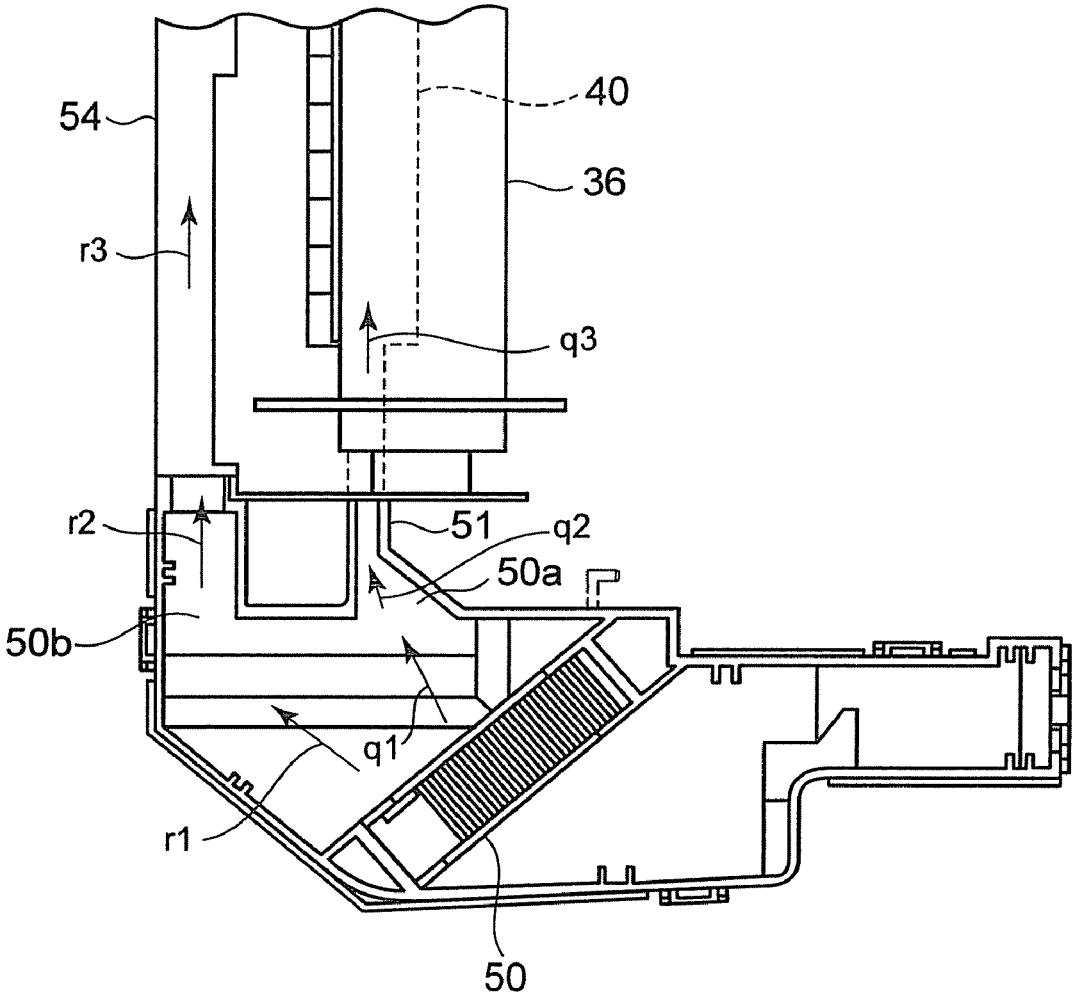
FIG. 6 is a schematic layout showing a cooling section according to the embodiment of the invention.

To overcome such trouble, a cooling section is provided in the induction heating device 40. That is, as shown in FIG. 5, a duct 51 that is a conductive member is arranged in contact with flat top surfaces 48 of the magnetic cores 46*a*, 46*b* and 46*c* in the induction heating device 40. Moreover, as shown in FIG. 6, outer air is flowed through the duct 51 by a fan 50, which is a pump and an air blow mechanism provided outside of the induction heating device 40. This fan 50 and the duct 51 form the cooling section. The duct 51 is formed by molded heat-resistant PC (polycarbonate resin)+ABS (acrylonitrile-butadiene-styrene resin). The duct 51 is tightly adhered to the inner circumference of the bent coil parts 47*a*, in slits 52 which are hole structures formed between the magnetic cores 46*a*, 46*b* and 46*c* at the bent coil parts 47*a* when the conductor wire 47 is wound around the magnetic cores 46*a*, 46*b* and 46*c*. That is, the slits 52 are filled with the duct 51.

The fan 50 also serves as an air blow mechanism which supplies outer air to the inside of a partition 54 formed on the outer circumference of the fixing device 28 in the printer unit 7. The partition 54 thermally insulates a toner bottle 53 as a peripheral device and the fixing device 28. Therefore, outer air taken in by the fan 50 is supplied to a duct connecting part 50*a* connected to the duct 51, and to a partition connecting part 50*b* connected to the partition 54.

Next, the operation will be described. When an image forming process is started, in the printer unit 7, tone images are formed on the photoconductive drums 12Y, 12M, 12C and 12K in the yellow (Y), magenta (M), cyan (C) and black (K) image forming stations 11Y, 11M, 11C and 11K respectively. Then, the toner images of these colors formed on the photoconductive drums 12Y, 12M, 12C and 12K are primary-transferred to the transfer belt 10 respectively, thus forming a full-color toner image on the transfer belt 10. Moreover, the full-color toner image formed on the transfer belt 10 is secondary-transferred onto the sheet paper P at the secondary transfer position at a time. After that, the sheet paper P is passed through the nipping part 38 between the heat roller 36 and the press roller 37 in the fixing device 28, and the full-color toner image is fixed on the sheet paper P by being heated and pressurized. A print image is thus completed.

As this image forming process is started, the heat roller 36 in the fixing device 28 is driven in the direction of the arrow t and the press roller 37 following the heat roller 36 is rotated in the direction of the arrow u. While fixation is carried out, in the fixing device 28, feedback control of power supplied to the induction heating device 40 is carried out in accordance with the result of detection of the surface temperature of the heat roller 36 by the thermistor 42. Thus, the heat roller 36 maintains a desired fixing temperature.

While the image forming process is carried out, the fan 50 is driven. Outer air taken by the fan 50 is flowed into the duct 51 via the duct connecting part 50*a*, as indicated by arrows q1, q2 and q3. In this manner, as the duct 51 directly contacts the inner circumference of the bent coil part 47*a* as a cooling target, the inner circumference of the bent coil part 47*a* and hence the entire area of the bent coil part 47*a* are directly cooled. Moreover, the top surfaces 48 of the magnetic cores 46*a*, 46*b* and 46*c*, which directly contact the duct 51, and hence the entire area of the magnetic cores 46*a*, 46*b* and 46*c* are directly cooled. However, the area of the induction heating device 40 that is not in contact with the duct 51 is not influenced by the outer air supplied by the fan 50.

The outer air taken in by the fan 50 is also flowed into the partition 54 via the partition connecting part 50*b*, as indicated by arrows r1, r2 and r3. Therefore, the toner bottle 53 is thermally insulated from the fixing device 28, irrespective of temperature rise in the fixing device 28.

According to this embodiment, outer air is passed through the duct 51 that is in contact with the bent coil parts 47*a* of the center coil 40*a* and the front- and rear-side coils 40*b* and 40*c* of the induction heating device 40 and also in contact with the flat top surfaces 48 of the magnetic cores 46*a*, 46*b* and 46*c*, and the bent coil parts 47*a* and the magnetic cores 46*a*, 46*b* and 46*c* are directly cooled.

Thus, the bent coil parts 47*a*, which are cooling target areas in the induction heating device 40, can be efficiently cooled. Therefore, the temperature of the bent coil parts 47*a* does not exceed the Curie point and temperature rise in the bent coil parts 47*a* can be securely prevented. The fixing device 28 can be prevented from becoming incapable of fixing because of lowered magnetic permeability of the magnetic cores 46*a*, 46*b* and 46*c*. Also, the film covering the conductor wires 47 used for the center coil 40*a* and the front- and rear-side coils 40*b* and 40*c* can be set to have low heat resistance capability, and reduction in the cost of the conductor wires 47 and coil peripheral components and hence reduction in the cost of the induction heating device 40 can be realized.

Meanwhile, outer air taken into the induction heating device 40 by the fan 50 is hermetically sealed by the duct 51. Therefore, the other areas than the cooling targets, which are not in contact with the duct 51, are hardly influenced by the outer air. Thus, unlike the conventional technique, reduction in heating efficiency of the heat roller 36 due to the influence of temperature fall on the entire area of the induction heating device 40 does not occur, and energy saving at the time of heating of the heat roller 36 can be realized.

This invention is not limited to the above embodiment and various changes and modifications can be made without departing from the scope of the invention. For example, the endless heated member may be a fixing belt. The structure, material and the like of the cooling section are not particularly limited, either. Instead of the duct, a heat pipe through which a liquid coolant is circulated may be connected to the bent parts of the coils. Also, instead of the (PC+ABS) duct, a metal duct insulated from the coils may be connected to the bent parts of the coils. As the duct is thus made of metal, the duct can also be provided with an electromagnetic shielding function. Therefore, the effect of preventing leakage of noise due to electromagnetic waves from the coils can be improved and adverse effects of electromagnetic waves on the periphery can be prevented. Moreover, the hole structure formed in the coil bent part is arbitrary. After the bent part is formed, the coils forming the bent part may be forcibly pushed aside to form the hole structure.

What is claimed is:

1. A cooling mechanism of a fixing device comprising:

a metal member which comprises a metal layer;

a counter-member configured to nip a recording medium together with the metal member;

a magnetic core;

a coil which is parallel to the metal layer in a flat part thereon and which is bent away from the metal layer to form a hole structure with the magnetic core at a bend part thereon, configured to generate an induction current in the metal layer; and a cooling section in contact which passes through the hole structure.

2. The cooling mechanism for a fixing device according to claim 1, wherein the cooling section has a conductive member in contact with the bent part, and a pump that sends a coolant to the conductive member.

3. The cooling mechanism for a fixing device according to claim 2, wherein the conductive member is a hollow duct, and the pump is an air blow mechanism that flows air into the duct.

4. The cooling mechanism for a fixing device according to claim 1, wherein plural units of the coil are arranged in a direction of rotation axis of the metal member, and the cooling section contacts the bent parts of the plural coils.

5. The cooling mechanism for a fixing device according to claim 1, wherein the cooling section has a conductive member that fills the hole structure, and a pump that sends a coolant to the conductive member.

6. The cooling mechanism for a fixing device according to claim 5, wherein the conductive member is laid along the magnetic core and in contact with the magnetic core.

7. The cooling mechanism for a fixing device according to claim 5, wherein the conductive member is a hollow duct, and the pump is an air blow mechanism that flows air into the duct.

8. The cooling mechanism for a fixing device according to claim 7, wherein plural coils are arranged in a direction of rotation axis of the metal member, and the hollow duct is laid along the magnetic core and in contact with the magnetic core and fills the plural hole structures of the plural coils.

9. The cooling mechanism for a fixing device according to claim 7, further comprising a partition that thermally insulates a peripheral device from the metal member, wherein the air blow mechanism also serves as an air blow mechanism to supply air into the partition.

10. The cooling mechanism for a fixing device according to claim 1, wherein the magnetic core varies a magnetic permeability thereof according to a temperature thereof.

11. The cooling mechanism for a fixing device according to claim 1, wherein the cooling section passes through the hole structure in contact with the bent part.

12. A cooling method for a fixing device comprising:

generating an induction current in a metal member comprising a metal layer which together with a counter-member is configured to nip a recording medium, the induction current is generated by a coil that is parallel to the metal layer in a flat part thereon to form a hole structure with a magnetic core at a bend part on the coil; and sending a coolant to pass through the hole structure.

13. The cooling method for a fixing device according to claim 12, wherein the conductive member is a duct, and the coolant is air.

* * * * *